US005481845A

United States Patent [19]

Koenig, Jr.

[11] Patent Number: 5,481,845

[45] Date of Patent: Jan. 9, 1996

[54] FLEXIBLE CORNER FOR TRIMMING CURVED WALL

[75] Inventor: Joseph M. Koenig, Jr., Lincolnwood, Ill.

[73] Assignee: Trim-Tex, Inc., Lincolnwood, Ill.

[21] Appl. No.: 291,769

[22] Filed: Aug. 17, 1994

[51] Int. Cl.[6] ..... E04C 2/38

[52] U.S. Cl. ..... 52/717.03; 52/287.1; 52/717.05

[58] Field of Search ..... 52/717.03, 716.8, 52/717.05, 283, 288.1, 506.06, 506.07, 506.08, 263, 287.1

[56] References Cited

U.S. PATENT DOCUMENTS

| | | | |
|---|---|---|---|
| 3,159,251 | 12/1964 | Becker | 189/85 |
| 5,247,769 | 9/1993 | Becker | 52/484 |

OTHER PUBLICATIONS

Trim–Tex Catalog dated Apr. 1993—see p. 11.

Trim–Tex Brohcure for "Flexible Grid Angle", undated—admitted prior art.

Radii Systems, Brochure for "The Radii Trim System", four pages, undated—admited prior art.

*Primary Examiner*—Kien T. Nguyen

*Attorney, Agent, or Firm*—Dressler, Goldsmith, Shore & Milnamow, Ltd.

[57] ABSTRACT

An improved, elongate, flexible corner for trimming a curved surface, such as a cylindrical surface of a building column, comprises an elongate angle extruded from a relatively hard but flexible, polymeric material and an elongate strip extruded from a relatively soft but pliable, polymeric material. The elongated angle and the elongate strip are coextruded respectively from polyvinyl chloride having different durometer hardnessess. The elongate angle has a first, relatively wide, relatively thick flange with a distal edge and a proximal edge and a second, relatively narrow, relatively thin flange with a distal edge and a proximal edge, which is unitary with the proximal edge of the first flange. The second flange extends from the first flange, approximately at a right angle relative to the first flange when the flexible corner is unstressed. Each of the first and second flanges has an inner surface and an outer surface and the inner surfaces define approximately a right angle relative to each other. The elongate strip is attached to the elongate angle, along the flexible corner. The elongate strip is configured so as to have a proximal portion covering the outer surface of the second flange, as far as the outer wall of the first flange, and a distal portion extending beyond the distal edge of the second flange, approximately at a right angle relative to the first flange when the flexible corner is unstressed, and so as to have a recess receiving the second flange.

6 Claims, 1 Drawing Sheet

FIG. 1
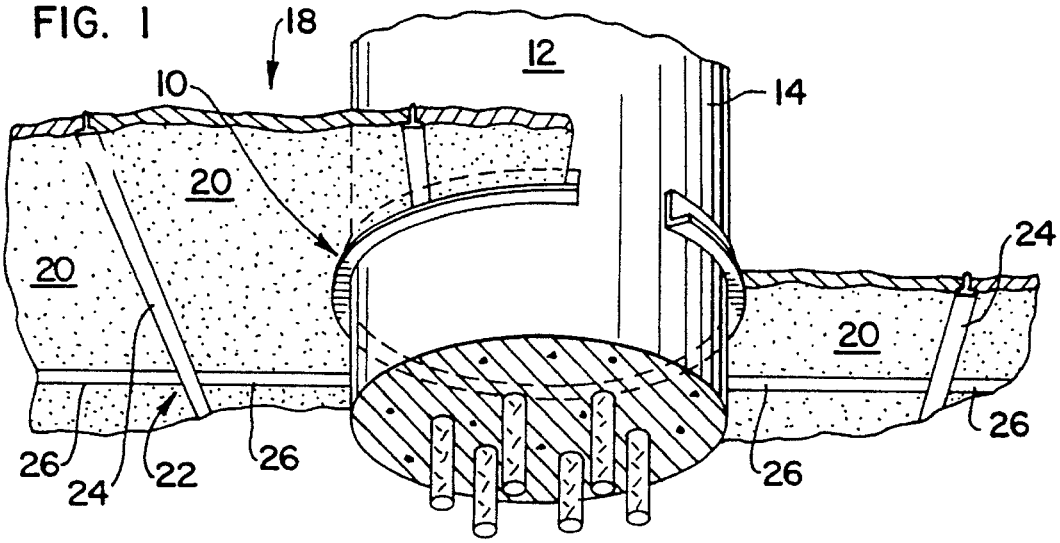
FIG. 2
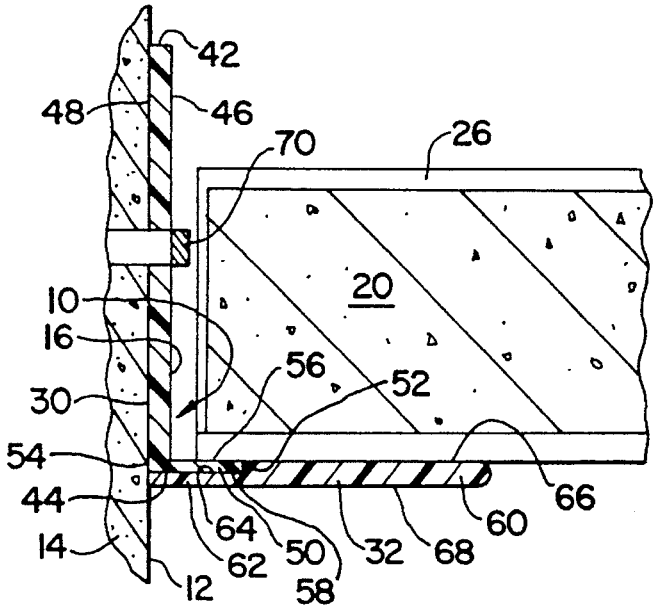
FIG. 3
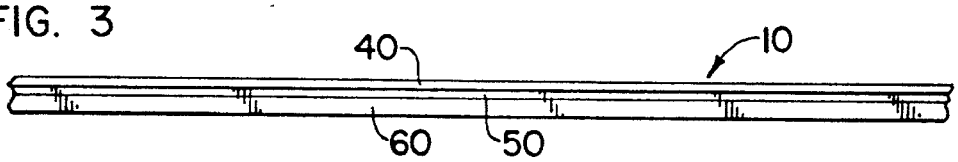
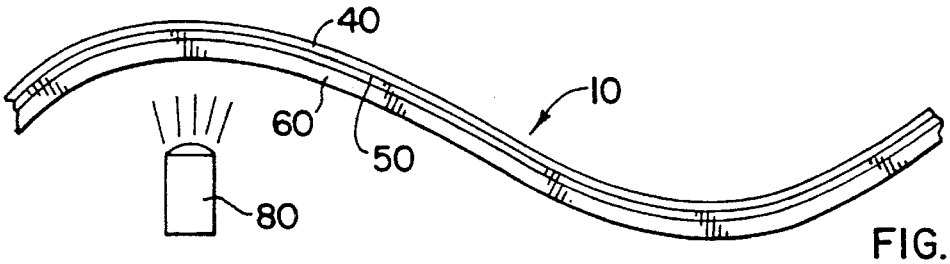
FIG. 4

FLEXIBLE CORNER FOR TRIMMING CURVED WALL

TECHNICAL FIELD OF THE INVENTION

This invention pertains to an improved, flexible corner comprising an elongate angle and an elongate strip attached to the elongate angle for trimming a curved wall, as exemplified by the cylindrical wall of a cylindrical column passing through a substantially circular cutout in a suspended ceiling system, which comprises ceiling tiles supported by a suspended grid.

BACKGROUND OF THE INVENTION

As exemplified in Becker U.S. Pat. No. 3,159,251, it has been known to make a flexible corner from a metal strip having two mutually perpendicular flanges, one of which has spaced notches along its length, and a stretchable tape covering an outer side of the notched flange. As explained therein, the flexible corner is useful for trimming a curved wall of a building column passing through a generally circular cutout in a suspended ceiling system, which comprises ceiling tiles supported by a suspended grid. A substantially similar corner having similar utility and employing a metal strip and a stretchable tape is disclosed in Becker U.S. Pat. No. 5,247,769.

Having similar utility, a flexible corner made from a hard but flexible, polyvinyl chloride strip having two mutually perpendicular flanges, one of which has spaced notches along its length, and a stretchable tape covering an outer side of the notched flange has been available commercially for several years from Trim-Tex, Inc. of Lincolnwood, Ill., under Stock No. 8158.

When such a flexible corner is used with a cylindrical column passing through a circular opening in a suspended ceiling system, the other flange is curved around the cylindrical column so as to spread the notches in the notched flange, and so as to stretch the tape. As supported by a suspended grid comprising grid members, adjacent ceiling tiles are provided with cut edges defining a substantially circular cutout, through which the cylindrical column passes. In a given installation, the notched flange may have to support some of the weight of the suspended ceiling system, particularly if and where cut ends of adjacent grid members overlie the notched flange.

Although the flexible corner noted above as available commercially from Trim-Tex, Inc., has proved to be generally acceptable to contractors and other users, it has not been entirely satisfactory. While the stretched tape is intended to conceal the spread notches, the cut edges of adjacent ceiling tiles, and the cut ends of adjacent grid members and to present a smooth appearance along its lower surface, it is difficult to avoid forming noticeable reliefs in the stretched tape, in a pattern corresponding generally to the spread notches.

Recently, it has been proposed by another party to employ an elongate angle, which is extruded from a soft, pliable, polymeric material so as to have two mutually perpendicular flanges, neither of which has any notches. If one flange is curved around a cylindrical column, the other flange is stretched into an annular shape, which is intended to present a smooth appearance along its lower surface. If one flange is curved oppositely, the other flange assumes a generally annular but somewhat rippled shape, which can be substantially smoothed by heating of its lower surface by means of a heat gun.

The elongate angle described in the preceding paragraph may not be entirely satisfactory when used with a cylindrical column and with a suspended ceiling system, as the pliable material of the stretched flange tends to sag noticeably, particularly if and where the stretched flange has to bear some of the weight of the suspended ceiling system.

SUMMARY OF THE INVENTION

This invention provides an improved, flexible corner for trimming a curved surface, as exemplified by a cylindrical wall of a building column passing through a circular cutout in a suspended ceiling system comprising ceiling tiles supported by a suspended grid. Broadly, the improved, flexible corner comprises an elongate angle extruded from a relatively hard but flexible, polymeric material and an elongate strip extruded from a relatively soft and pliable, polymeric material. Preferably, the elongated angle and the elongate strip are coextruded from polyvinyl chloride having different durometer hardnesses.

The elongate angle has a first flange with a distal edge and a proximal edge and a second flange with a distal edge and a proximal edge, which is unitary with the proximal edge of the first flange. The second flange extends from the first flange approximately at a right angle relative to the first flange when the flexible corner is unstressed. Each of the first and second flanges has an inner surface and an outer surface and the inner surfaces define approximately a right angle relative to each other.

The elongate strip is attached to the elongate angle, along the flexible corner, and is configured so as to extend beyond the distal edge of the second flange of the elongate angle, approximately at a right angle relative to the first flange of the elongate angle when the flexible corner is unstressed.

When the improved, flexible corner is used with a cylindrical column passing through a circular opening in a suspended ceiling system, the relatively wide flange of the elongate angle is curved around the cylindrical column, whereby the second flange and the elongate strip extending beyond the second flange are stretched into an annular shape. Thus, the second flange is positioned to bear some of the weight of a suspended ceiling system having a circular opening, through which the cylindrical column passes, and the elongate strip extending beyond the relatively narrow flange does not have to bear any weight of the suspended ceiling system.

Although the elongate angle is extruded from a relatively hard, polymeric material, the second flange can be thus stretched into an annular shape along with the elongate strip extruded from a relatively soft and pliable, polymeric material, particularly if the first flange is relatively wide and relatively thick and if the second flange is relatively narrow and relatively thin.

Preferably, the elongate strip is configured so as to have a proximal portion covering the elongate flange along the outer surface of the second flange, as far as the outer wall of the first flange, and a distal portion extending beyond the distal edge of the second flange, approximately at a right angle relative to the first flange when the flexible corner is unstressed. Preferably, moreover, the elongate strip is configured so as to have a recess receiving the second flange.

These and other objects, features, and advantages of this invention are evident from the following description of a preferred embodiment of this invention with reference to the accompanying drawings.

BRIEF DESCRIPTION OF THE DRAWINGS

FIG. 1 is a fragmentary, perspective view of a flexible corner constituting a preferred embodiment of this invention, as used for trimming a cylindrical wall of a building column passing through a circular cutout in a suspended ceiling system comprising ceiling tiles supported by a suspended grid comprising longitudinal members and transverse members.

FIG. 2, on a larger scale, is a fragmentary, sectional view taken through the flexible corner, the cylindrical column, and the suspended ceiling system.

FIG. 3 is a plan view showing the flexible corner in an unstressed condition.

FIG. 4 is a plan view showing the flexible corner in a doubly curved condition.

DETAILED DESCRIPTION OF PREFERRED EMBODIMENT

As shown in FIGS. 1 and 2, a flexible corner 10 constituting a preferred embodiment of this invention is used for trimming a cylindrical wall 12 of a building column 14 passing through a substantially circular cutout 16 in a suspended ceiling system 18. The suspended ceiling system 18 comprises ceiling tiles 20 supported by a grid 22, which comprises longitudinal members 24 and transverse members 26, and which is suspended from a ceiling (not shown) by wires (not shown) in a known manner. Where the substantially circular cutout 16 is provided, adjacent ceiling tiles 20 have cut edges, and adjacent grid members 24, 26, have cut ends. The flexible corner 10 conceals such cut edges and such cut ends around the substantially circular cutout 16.

Broadly, the flexible corner 10 comprises an elongate angle 30 extruded from a relatively hard but flexible, polymeric material and an elongate strip 32 extruded from a relatively soft and pliable, polymeric material and attached to the elongate angle 30, along the entire length of the flexible corner 10. Preferably, the elongated angle 30 and the elongate strip 32 are coextruded from polyvinyl chloride having different durometer hardnessess, more preferably polyvinyl chloride of 82 D Scale durometer hardness for the elongate angle 30 and polyvinyl chloride of 105 A Scale durometer hardness for the elongate strip 32, whereby the elongate angle 30 and the elongate strip 32 are attached to each other along the entire length of the flexible corner 10.

As shown in FIG. 2, the elongate angle 30 is extruded so as to have a profile defining a first, relatively wide, relatively thick flange 40 with a distal edge 42 and a proximal edge 44 and defining a second, relatively narrow, relatively thin flange 50 with a distal edge 52 and a proximal edge 54, which merges with the proximal edge 44 of the relatively wide, relatively thick flange 40. The first flange 40 has an inner surface 46 and an outer surface 48. The second flange 50 extends from the first flange 40 approximately at a right angle relative to the first flange 40 when the flexible corner 10 is unstressed. The second flange 50 has an upper surface 56 and a lower surface 58. When the flexible corner 10 is unstressed, the surfaces 46, 56, meet approximately at a right angle relative to each other, and the surfaces 48, 58, meet approximately at a right angle relative to each other.

As shown in FIG. 2, the elongate strip 32 is extruded so as to have a profile defining a thicker, distal portion 60 and a thinner, proximal portion 62. The distal portion 60 extends from the proximal portion 62, beyond the distal edge 52 of the second flange 50. Being thinner than the distal portion 60, the proximal portion 62 defines a recess 64 receiving the second flange 50. Moreover, the proximal portion 62 covers the outer surface 58 of the second flange 50 entirely. The distal portion 60 has an upper surface 66, which is coplanar with the upper surface 56 of the second flange 56 when the flexible corner 10 is unstressed.

As shown in FIG. 2, the first flange 40 is curved around the cylindrical column 14, to which the first flange 40 is fastened by staples 70 (one shown) or otherwise. Thus, the second flange 50 and the elongate strip 32 are stretched into an outwardly extending, generally annular shape, which has a smooth appearance along the lower surface 68 of the elongate strip 32. The second flange 50 is positioned to support some of the weight of the suspended ceiling system 18 without sagging noticeably, particularly if and where the cut ends of adjacent grid members 24, 26, overlie the second flange 50. As a result, the distal portion 60 of the elongate strip 32 does not have to bear any of the weight of the suspended ceiling system 18. Therefore, the distal portion 60 does not sag noticeably.

As shown in FIG. 4, the first flange 40 can be oppositely curved as well, whereby the second flange 50 and the elongate strip 32 tend to form an inwardly extending, generally annular but somewhat rippled shape, which can be substantially smoothed by heating of the lower surface 68 of the elongate strip 32 by means of a heat gun 80.

Various modifications may be made in the preferred embodiment described above without departing from the scope and spirit of this invention.

I claim:

1. An elongate, flexible corner for trimming a curved surface, the flexible corner comprising (a) an elongate angle extruded from a hard, flexible, polymeric material, comprising a first flange with a distal edge and a proximal edge, and comprising a second flange with a distal edge and a proximal edge, which is unitary with the proximal edge of the first flange, the second flange being smaller than the first flange and extending from the first flange approximately at a right angle relative to the first flange when the flexible corner is unstressed, the elongate angle having a generally uniform width measured between the distal and proximal edges of the second flange, at any point along the flexible corner, and (b) an elongate strip extruded from a soft, pliable, polymeric material softer than the material of the elongate angle, the elongate strip being attached to the elongate angle, along the flexible corner, and being configured so as to have a proximal portion extending beyond the distal edge of the second flange, approximately at a right angle relative to the first flange when the flexible corner is unstressed, the extending portion being wider than the generally uniform width of the elongate angle.

2. The elongate, flexible corner of claim 1 wherein the first flange is wider and thicker, as compared to the second flange.

3. The elongate, flexible corner of claim 2 wherein the second flange has an outer surface facing away from the distal edge of the first flange, wherein the first flange has an outer wall facing away from the second flange, and wherein the elongate strip is extruded with the a proximal portion covering the outer surface of the second flange, as far as the outer wall of the first flange, the elongate strip having a distal portion extending beyond the distal edge of the second flange, approximately at a right angle relative to the first flange when the flexible corner is unstressed.

4. The elongate, flexible corner of claim 3 wherein the proximal portion of the elongate strip has a recess receiving the second flange.

5. The elongate, flexible corner of any of claims 1, 2, 3, and 4 wherein the elongate angle and the elongate strip are coextruded, the flexible corner having a substantially identical cross-section at any point along the flexible corner.

6. The elongate, flexible corner of any of claims 1, 2, 3, and 4 wherein the elongate angle and the elongate strip are coextruded respectively from polyvinyl chloride having different durometer hardnesses, the flexible corner having a substantially identical cross-section at any point along the flexible corner.

* * * * *